US006394296B1

(12) United States Patent
Elvin-Jensen et al.

(10) Patent No.: US 6,394,296 B1
(45) Date of Patent: May 28, 2002

(54) FOLDING BULK CONTAINER

(76) Inventors: Marc P Elvin-Jensen, 129 Owen Stanley Avenue, Allambie Heights, NSW 2100 (AU); Gavin J Elvin-Jensen, 3 Turquoise Way, San Michelle, Noordhoek 7985, Cape Town (ZA)

( * ) Notice: Subject to any disclaimer, the term of this patent is extended or adjusted under 35 U.S.C. 154(b) by 0 days.

(21) Appl. No.: 09/596,367

(22) Filed: Jun. 16, 2000

(30) Foreign Application Priority Data

Jun. 18, 1999 (AU) ..... PQ1071

(51) Int. Cl.[7] ..... B65D 6/18
(52) U.S. Cl. ..... 220/6; 206/509; 206/511
(58) Field of Search ..... 220/6, 7; 206/600, 206/386, 511, 509, 599

(56) References Cited

U.S. PATENT DOCUMENTS 4,735,330 A * 4/1988 Hoss ..... 220/7
4,961,509 A * 10/1990 Currier ..... 220/630
5,180,064 A * 1/1993 Elvin-Jensen ..... 206/599
5,370,256 A * 12/1994 Fourie et al. ..... 220/6
5,398,834 A * 3/1995 Umiker ..... 220/7
5,439,113 A * 8/1995 Elvin-Jensen ..... 206/511
5,494,182 A * 2/1996 Clive-Smith ..... 220/7
5,788,103 A * 8/1998 Wagner et al. ..... 220/6
5,829,617 A 11/1998 Umiker et al. ..... 220/6

FOREIGN PATENT DOCUMENTS

NZ 303108 8/1998
NZ 326766 8/1999

* cited by examiner

*Primary Examiner*—Stephen Castellano
(74) *Attorney, Agent, or Firm*—Dick and Harris

(57) ABSTRACT

A folding bulk container, such as may be used for the bulk transport of fruit produce and the like, includes a base unit having at least one peripheral edge wall which has all outer surface, an inner surface and an upper surface, and at least one side wall pivotably mounted on the base unit about an axis adjacent the edge wall for movement between an erect position and a folded position. The container is foldable and may be stackable with like containers. The side wall may cooperate with the edge wall in releasable engagement when in the erect position.

27 Claims, 7 Drawing Sheets

FOLDING BULK CONTAINER

Bulk fruit containers are typically containers having a "footprint" the size of a typical pallet which may be used to transport fruit and the like.

Bulk fruit containers may be disposable and made of cardboard or the like or partially or totally reusable. Partially or totally reusable bulk containers have a plastics base and side walls of cardboard or plastics material.

The use of cardboard for bulk containers is becoming less acceptable since the cardboard remains at the destination and is considered waste. The European Union is proposing to require all retail packaging material imported into the EU to be removed to the country of origin. This makes the use of reusable bulk containers much more attractive, if not essential, than previously.

Whilst reusable bulk containers exist, they suffer from lack of durability, rigidity and poor volumetric efficiency and excessive height when folded.

The present invention, in its various forms, aims to improve the performance of folding balk containers in these areas.

Durability and Rigidity of the Base

Some existing base units for bulk containers are injection moulded as a single structure, with the support feet integral with the base. To form the feet with a continuous surface, openings must be left in the upper surface of the base, which are then closed with press-in inserts. This construction may result in a weak base with insufficient rigidity of the base. The base tends to fail at the junction of the feet, particularly if the base is held in racks and only supported at its edges or corners.

A base unit may be made with separate feet and base which are subsequently welded together. These units are moved by fork lift when loading or unloading trucks or being otherwise moved. The feet are frequently hit either by the tyres of the fork lift or are hit against a solid object, such as the top of a loading dock or the side of a truck. This can shear off the feet at the weld line.

Accordingly in an attempt to improve the durability and rigidity of the base of a bulk container, one aspect of the invention provides a base unit including:

- a base having an underside surface;
- at least one support mounted to the underside of the cross-sectional base;
- one of the support and base having at least one male extension extending into a female receptacle in the other of the support and the base, said male extension having a cross-sectional width in a transverse direction and a cross-sectional length in a longitudinal direction, said female receptacle having a cross-sectional width in the transverse direction and a cross-sectional length in the longitudinal direction, wherein the cross-sectional width of the male extension and female receptacle extension are substantially the same and the cross-sectional length of the female receptacle is greater than he cross-sectional length of the respective male extension.

Preferably the at least one support is friction welded to he base.

Preferably the male extension is circular in cross-section and the receptacle is an oval in cross-section. However, a square or rectangular extension may be used with a rectangular receptacle or any other appropriate shape.

The cross-sectional length of the receptacle needs to be sufficiently large to enable free movement of the male extension in the longitudinal direction during friction welding. This helps withstand lateral and longitudinal impacts.

Most containers have three feet spaced across the width of the base. These feet are usually of the same width. In preferred forms of the invention, the central foot should be increased to nearly double the width of the edge feet (whereas conventional art usually has substantially equal width). This invention creates a significantly reduced unsupported span, thereby increasing the rigidity of the base.

SIDE WALL CONSTRUCTION

Existing folding bulk containers have four side walls which move between erect positions and collapsed positions. The base of the container has a peripheral wall running along each edge In existing containers the peripheral wall extends upwards more than 30 mm to 40 mm. The side walls, in the erect position, overlap the peripheral wall, so that any load on the side wall is transferred to the base of the container via the peripheral wall. Substantially most of the load is transferred Trough the hollow comers of the end wall. Most current systems have side walls which are about 40 mm thick and peripheral walls more than half tie thickness of the side wall. Further, many existing systems have a lift up/drop down type of pivoting arrangement rather than a true revolving action about a single, fixed axis. These factors tend to lead to excessive free play in the side walls and, more importantly excess collapsed height. In most systems the outer surface of the first side walls lies level with the upper edge of the peripheral wall. The side walls lock together in a way which requires one pair of opposed walls to have a female receptacle structure extending out of the general plane of the inner surface of the second side wall. This pair of walls is folded on top of the first pair and are mounted higher than the first pair so that this receptacle structure can lie on the horizontal outer surface of the first pair. This leads to excessive folded height An aspect of the invention aims to reduce the height of a folded bulk container by providing a base unit having:

- an elongate edge wall, said wall having an inner surface;
- a side wall pivotably mounted on the base inwardly of the inner wall surface about a revolving axis substantially parallel to the edge wall;
- said side wall being movable between an erect position in which it is approximately vertical and a folded position in which it is substantially approximately horizontal;
- said side wall having a first portion having first outer surface which, when in the erect position, extends generally vertically adjacent to the inner wall surface to at least the highest point of the edge wall, and when in the folded position extends generally horizontally below a horizontally plane passing through the said highest point.

The side wall preferably has a second portion with a second outer surface and the edge wall has an outer surface which is coplanar with the second outer sure when the side wall is in the erect position.

Preferably the edge wall has a top surface which may be flat or radiused and extending between generally downwardly between the inner surface to the outer surface.

Preferably there is an intermediate surface on the side wall extending between the first and second outer surfaces and preferably this intermediate surface is complementary to the top surface of the edge wall.

In the preferred embodiment the peripheral edge walls only extend upwards by 28 mm while the side walls are 40 mm thick. The first portion of the side wall, which lies adjacent the edge wall, is only 28 mm thick so that when folded it lies flush with the upper surface of the edge wall with the major portion of the side wall above the edge wall. This step at the edge the side wall is of sufficient height to receive the female receptacle structure of the second pair of walls, so that the inner surface of the second pair of walls may lie upon the outer surface of the first pair of side walls. Compared to conventional folding containers this saves a significant amount in folded height—12 mm in edge wall height and 12 mm in the mounting of the second pair of walls relative to the first pair.

HINGE LOCATION AND STRUCTURE

As mentioned, existing folding bulk containers suffer from excessive free play in the side walls when erecting. In particular, the side walls may be pivoted more 90°. This can result in damage to the hinge or likewise the end wall. In an attempt to reduce or eliminate this free play the invention in another aspect provides a folding bulk container including:

- a base unit including a peripheral edge wall which has an outer surface, an inner surface and an upper surface, and
- a side wall pivotably mounted on the base unit about an axis adjacent the edge wall for movement between an erect position and a folded position.

The edge wall may have an outer surface, an inner surface and an upper surface which extends upwardly from the outer surface to the inner surface.

Preferably the upper surface is inclined or arched at about 12° to the horizontal and the side wall has a surface complementary to the upper surface.

The geometry of the hinge pin relative to the bottom of the side and end walls is such that when the wall is moved through the arc from horizontal to vertical, the bottom of the walls lock against the floor of the base thereby discouraging the wall from going beyond 90 degrees. The unique nature of this geometry creates a secondary prevention of the wall being forced beyond 90 degrees in the form of the recessed lower bottom of the walls passing through an arc, the centre of which has placed the barrel hinge outer a full 40 mm inside the pallet base from the exterior of the peripheral wall and against the inner edge. This arc settles on top of the sloped peripheral wall, thereby locating the side wall in the upright position. The pin centre in the preferred forms of the invention is about 32 mm from the outer wall. Prior to this invention known art placed the pin within the peripheral wall.

Configuration of the Upper Surface of the Base

Bulk containers are normally square or rectangular and pallet sizes vary with countries. In some countries the short side of a rectangular pallet does not allow the long side's side walls to fold down without overlapping. This means the upper of the long side walls does not fold horizontally, which in turn means that the short side walls cannot fold down horizontally, so increasing the folded height of the container Accordingly, in another aspect of the invention, there is provided a base unit for a collapsible bulk container in which side walls are pivotably mounted on the base unit, between erect and folded positions, said base unit having an upper surface against which all or part of the inner surface of at let one of the side walls rests when in the folded position, said upper surface and said inner surface configured to allow the said at least one side wall to pivot more than 90° between thee vertical position and the folded position.

In a preferred embodiment this is achieved by having a V-shaped upper surface is Preferably the upper surface is symmetrical so that it does not matter which side wall is folded down first.

Preferably the lower of the two side walls pivots sufficiently to allow the second side wall to lie horizontally and lower than would otherwise be the case without this V.

ACHING STRUCTURE

In present folding bulk containers, the folding side walls engage with square or rectangular or circular shaped latches. Such configurations require undesirable looseness, since the lower latches travel through a smaller arc than the upper latches. In many systems the lower latches start to enter their respective female receptacle at about 45° whilst the upper latches enter almost horizontally.

To achieve a rigid design while allowing the side walls to pivot about a fixed axis, the invention, in yet another broad form, provides a folding bulk container having:

- a base;
- side walls pivotably mounted on the edges of tie base for movement between folded position and erect positions;
- adjacent pairs of erect side walls engaging each other by a series of engaging male tabs and female receptacles;
- said male tabs extending from an end wall of a fist pair of side walls and engaging in said female receptacles in an inner wall of the other of said pair,
- said tabs and receptacles extending away from tie axes of rotation of the two side walls;
- said tabs and receptacles having a generally triangular shape, the included angle of the apex of the tab and corresponding receptacle being less than the included angle of the apex of the adjacent tab nearer to the axis.

Preferably, the included angle of the apex of each tab ranges from about 80° adjacent the axis to about 20° furthest from the axis.

The receptacles near to or adjacent the axis may have a short horizontal lead in.

The included angle of the apex is preferably inversely proportional to the distance of the apex from the axis.

All tabs preferably have the same dimension across the thickness of the respective side wall.

PERIPHERAL EDGE WALL CONSTRUCTION

With corrugated cardboard walled containers, the volumetric efficiency is determined in part by the thickness of the peripheral edge walls. Typically these walls are about 24 mm or more wide and are formed as an upturned U with parallel side walls about 4 mm thick with a gap of about 16 mm. Using a blade between the side walls to form the gap requires a blade this thick to allow for proper cooling of the blade-thinner blades overheat. The present invention uses gas assist to create the actual peripheral wall, which may be reduced to an overall width of only 12 mm. Prior to this invention gas had been used to fill voids but never to create an entire wall. On a conventional pallet this can lead to a direct 4%–5% increase in internal volume.

Accordingly, in another aspect the invention provides an injection moulded plastics base including:

- an upper surface;
- an elongate peripheral wall extending from the upper surface along or adjacent at least part of the peripheral edge of the base, said peripheral wall being gas blown and extending along the length of the wall between inner and outer side walls.

The inner and outer walls are preferably each about one third the thickness of the peripheral wall

CONFIGURATION OF THE SIDE WALLS AND FEET

The stability of a stack of bulk containers may be improved if the stacks are positively locked together to act against creep or slip.

Accordingly, in yet a further aspect of the invention, there is provided a foldable bulk container including:

a base having longitudinally extending feet extending downwardly along or adjacent two spaced apart side edges;

side walls pivotably mounted on the base for movement between upright erect positions and horizontal folded positions, each of sad side walls having an inner surface, an outer surface, a thickness and an upper surface extending from the outer surface to said inner surface, wherein;

in said erect position said upper surface has a first portion which extends downwardly and inwardly from the outer surface and a second portion which extends inwardly and upwardly to said inner surface, and each of said legs have a lower surface, including a portion which extends upwardly and inwardly complementary to said second portion of said upper surface, whereby a plurality of erect containers may be stacked one on top of another and the complementary portion of a leg of a first container resting on the per surface of the side walls of the adjacent container below said first container.

Preferably the second portion extends upwardly at about 12° to the horizontal.

The invention is also applicable to cardboard walled containers where a concertina folded corrugated cardboard wall is held inside of the perimeter edge wall with stack locators with said 12 degrees.

In the known art the upper surface of the side walls is usually horizontal. Likewise the lower surface of the legs or feet in the known at is usually flat. We acknowledge the known art may have castellated surfaces or ledges to make location more positive. In the above mentioned format the 12 degree downward slope towards the exterior of the walls in combination with the downward slope of the outer edges of the legs of a similar 12 degree slope is claimed as an invention.

The phenomena of pressure induced sliding of bins moulded from polyethylene can cause the walls to bow and upper box to slide into the lower. The geometry of the underside of the foot and the corresponding sloped edge reverses this, and in fact induces the walls inwards, making the stack inherently more stable as the walls are pushed against the locating feet.

The invention shall be better understood from the following non-limiting description of preferred embodiments, in which.

Figure 1:
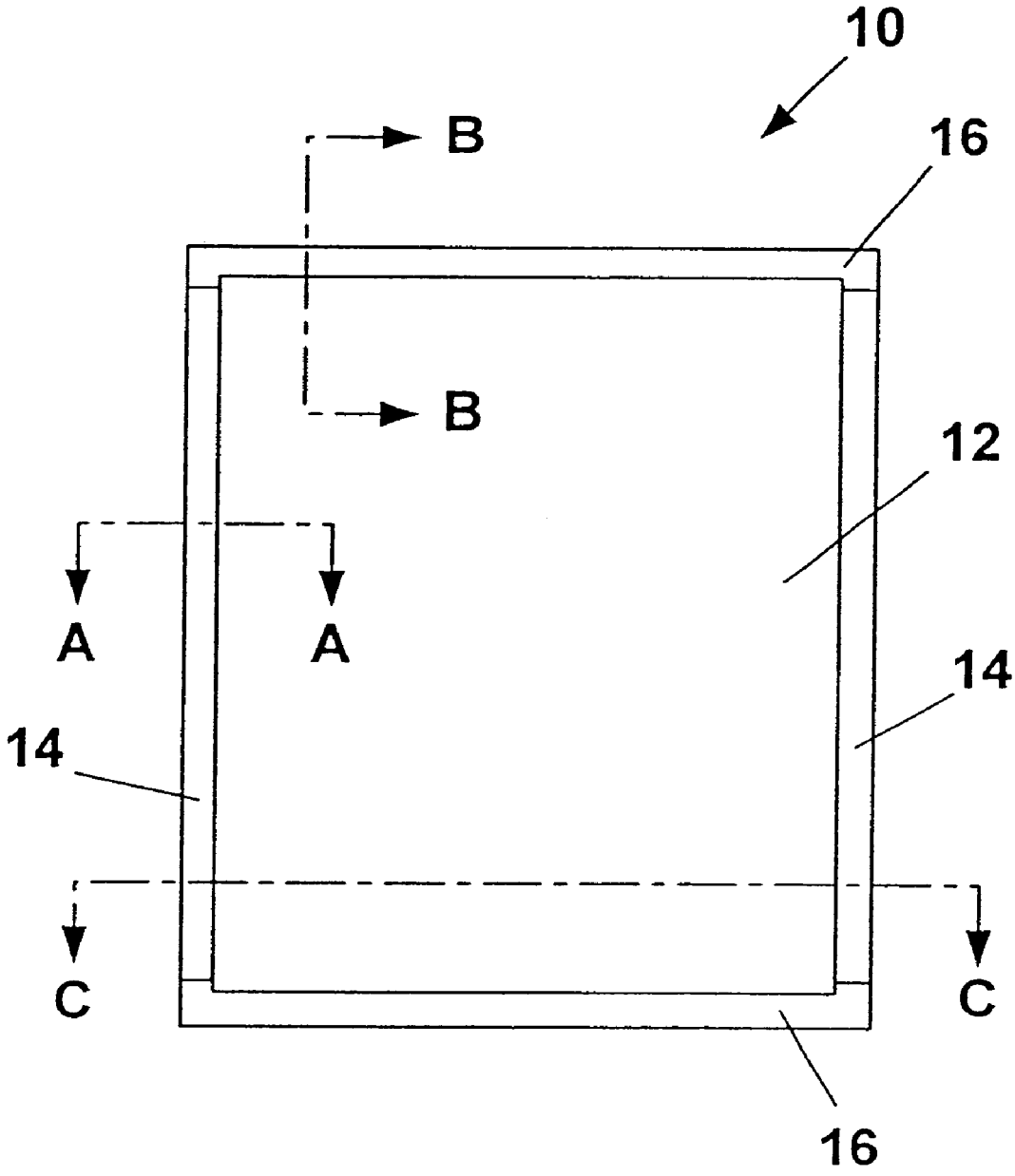
FIG. 1 is a plan view of a folding bulk container according to the invention.
Figure 2:
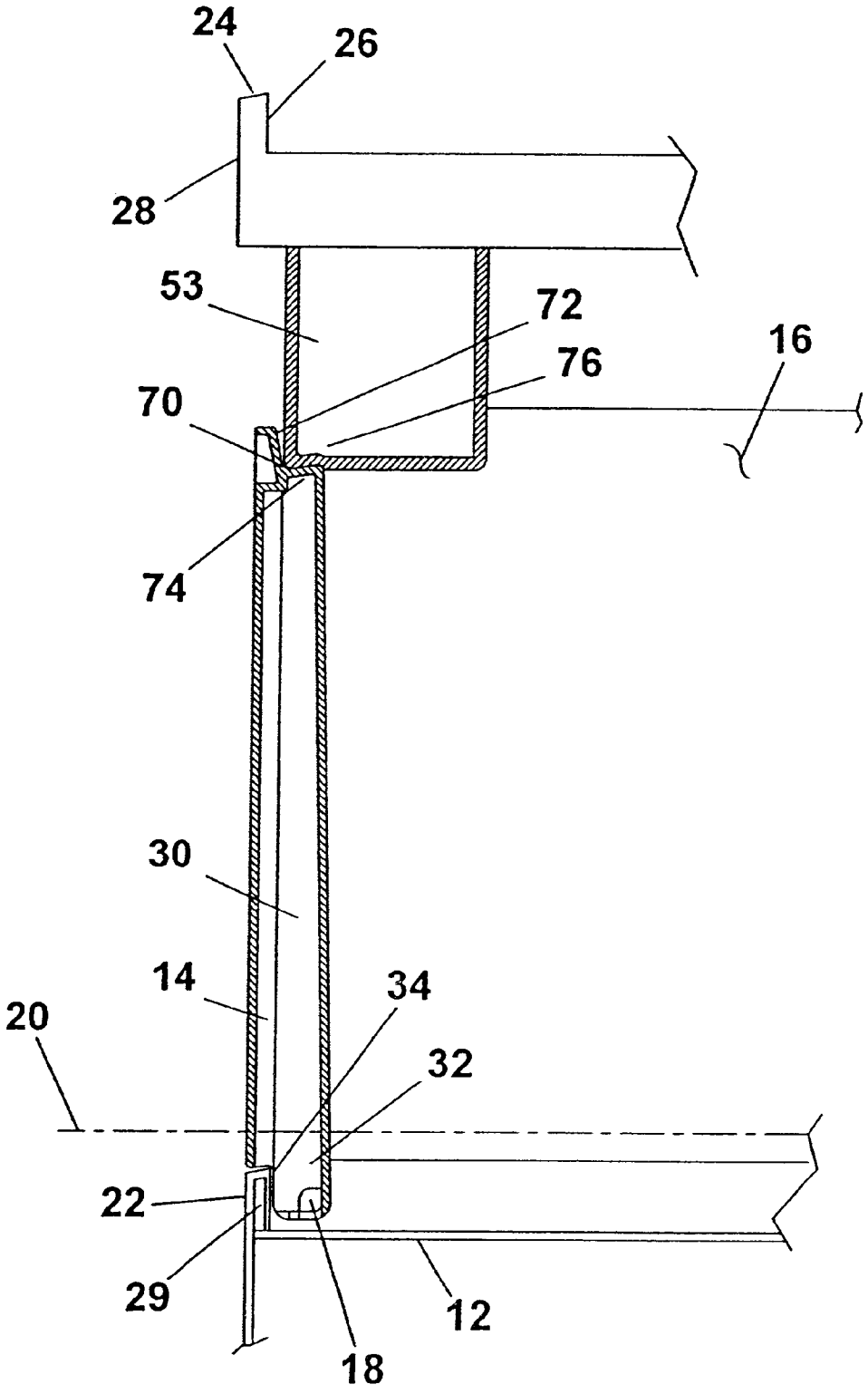
FIG. 2 is a cross-sectional view taken along line A—A of FIG. 1.
Figure 3:
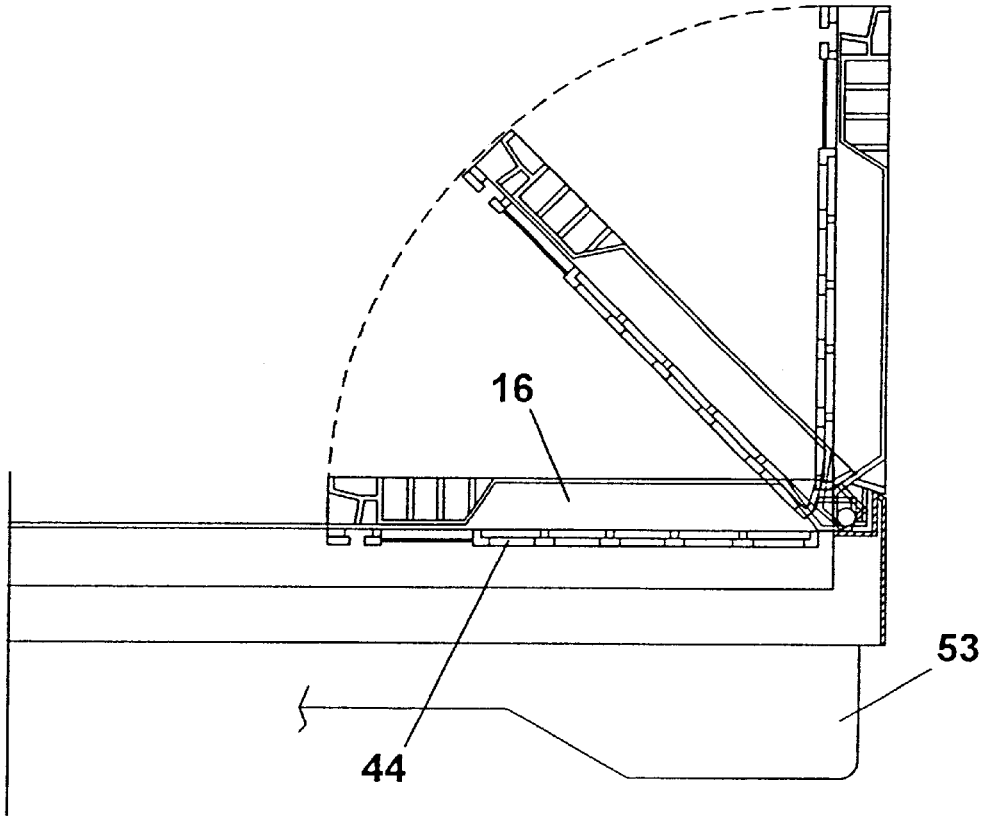
FIG. 3 is a cross-sectional view of a side wall of FIG. 1 in a folded position, erect and part erect positions taken along line B—B of FIG. 1.
Figure 4:
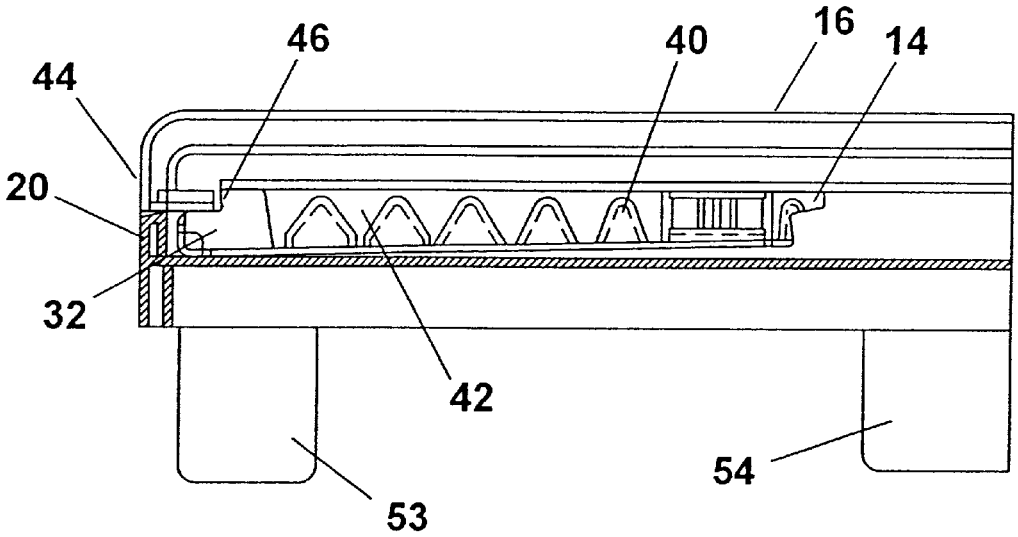
FIG. 4 is a partial cross-sectional view of the container of FIG. 1 with all the side walls folded down.
Figure 5:
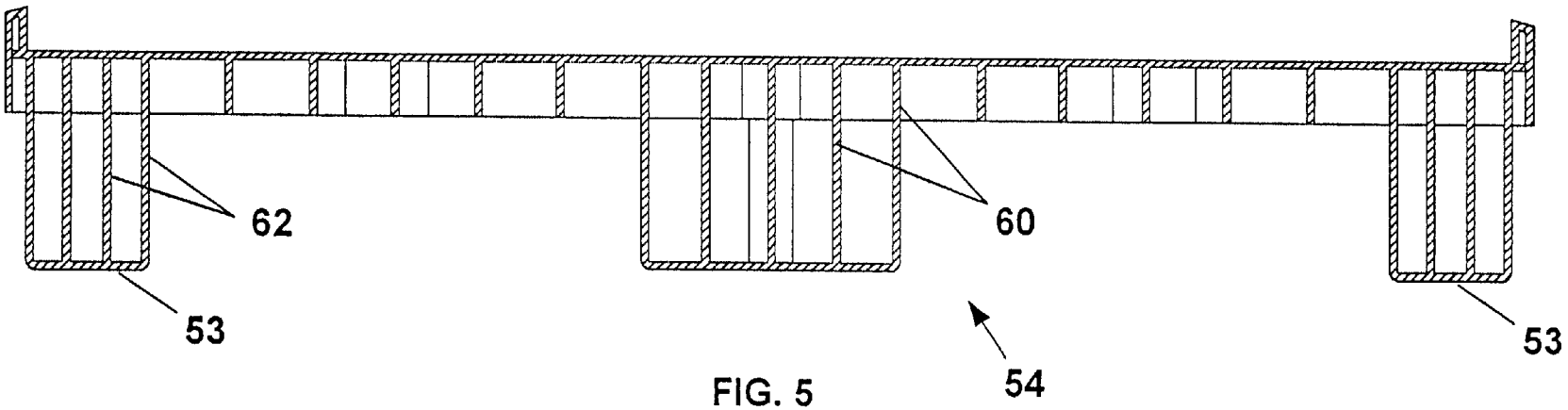
FIG. 5 is a cross-sectional view of the base of the container of FIG. 1 taken along line C—C. For clarity the side walls and hinge mountings are omitted.
Figure 6:
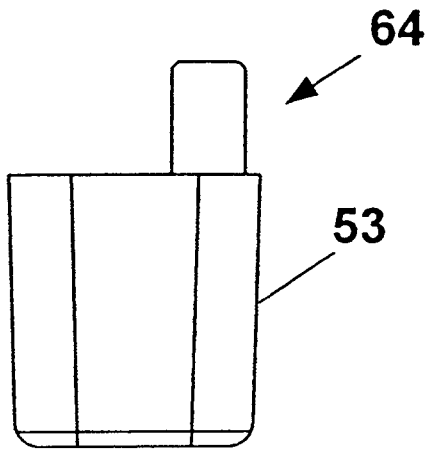
FIG. 6 is a side view of one of the supports for the container of FIG. 1.
Figure 7:
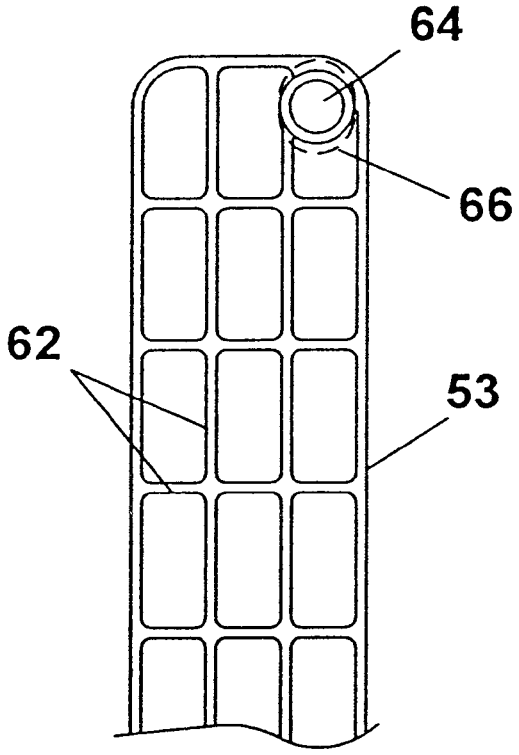
FIG. 7 is a plan view of the support of FIG. 6.
Figure 8:
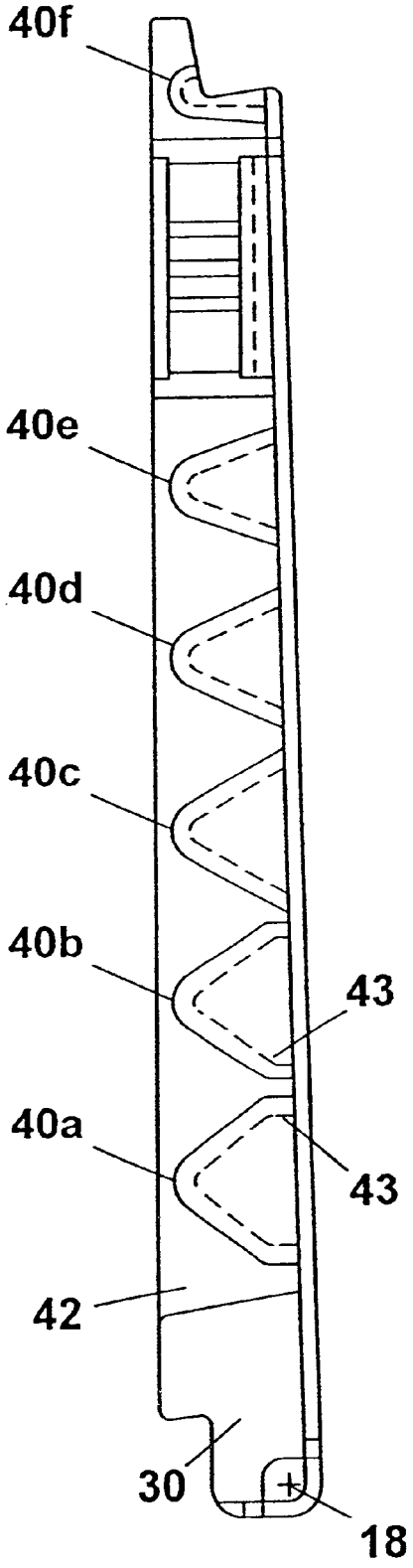
FIG. 8 is an end view of a male side wall of the container of FIG. 1.

Referring to the drawings there is shown a folding bulk container 10. The container 10 includes a base 12, a pair of male side walls 14 and a pair of female side walls 16.

The side walls 14, 16 are pivotably mounted on hinges 18, 20 as to be movable between an erect position and a folded position. The hinges are preferably barrel hinges and only allow rotation of the side walls relative to the base—there is no slot type arrangement which deliberately allows substantial radial movement of the side walls relative to the hinge line.

The container is designed to fold down to as low a height as possible and to provide a substantially planar upper surface when folded upon which another folded container may be placed. The male walls 14 are designed to be folded down first, between the erect female walls 16 and the female walls 16 then folded on top of the male walls 14. Accordingly the hinges 20 upon which the female walls are mounted are higher than the hinges 18 of the male walls.

To limit movement of the side walls the base 12 is provided with peripheral edge walls 22, which extend above the height of the respective binge lines and against which the side walls bear when erected.

The edge walls 22 are about 12 mm thick and about 28 mm high and in the preferred embodiment have upper surfaces 24 which slope downwards from the inner surface 26 toward the outer surface 28 at about 12°. Each edge wall is formed of an inverted U-shape with a void 29. This void is not formed by a blade but by gas assist during moulding and is, preferably, fully enclosed, which is not possible with conventional moulding. The walls of the edge wall am each about 4 mm thick and the void is about 4 mm thick.

The major portion 30 of each of the side walls 14, 16 nominally has a maximum thickness of about 40 mm but the minor portion 32 adjacent the edge wall is thinner. The hinge is preferably placed in this minor portion as low as possible and as close to the inner surface 26 as possible.

The horizontal distance of the outer surface 34 of the minor portion 32 from the axis 18 is preferably less than the height of the uppermost point of the edge wall 22 above the axis. Thus when the side wall is folded down, the outer surface 34 of the minor portion 32 does not lie above the edge wall 22.

In the preferred embodiment, the edge wall extends about 28 mm above the hinge line and the minor portion 32 of the side wall is about 28 mm thick. The transition surface 33 from the minor portion 32 to the major portion 30 is angled at about 12° so as to complement the upper surface of the peripheral wall. When erect, this surface 33 bears on the upper surface of the peripheral wall and prevents over rotation.

The base 35 of the side wall is also configured so that attempted over rotation beyond 90° will cause it to bear on the floor of the base 12.

The male side walls 14 have tabs 40 extending from their ends 42 which engage in female receptacles 44 provided on the inner surface 46 of the female side walls. The female walls are erected first and the male walls pivoted to engage the female walls. Thus the male tabs 40 must clear the inner surface 46 of the female walls, ie, the structure for female receptacles must extend inwardly of the inner surface of the female walls. The provision of the lower height minor portion 32 on the male side walls allows the female side walls to fold down with the female receptacle structure located in this lower portion and the major part of the female wall resting on major portion 30 on the male wall. The female receptacle structure extends approximately 12 mm from the general plane of the female walls 16. By providing a 12 mm recess at the edge of the male side walls 14, this allows the hinge of the female walls to be lowered by a corresponding 12 mm, so reducing the folded height of the container.

Figure 9:
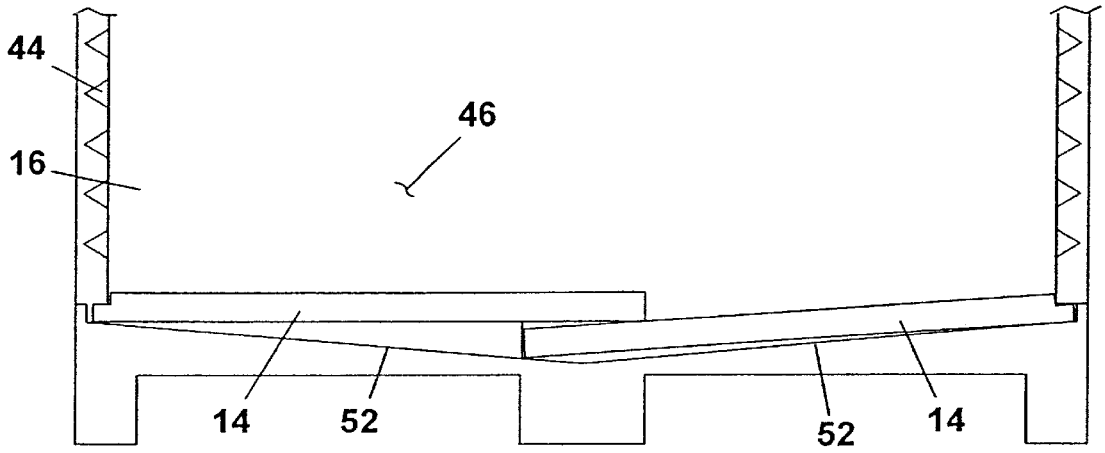
FIG. 9 is an alternate construction of the base of the folding container.

The bulk container is normally pallet sized with exterior dimensions of 1200 mm by 1000 mm with side walls extending upwards about 600 mm. Thus, normally, on the short side, even allowing for the thickness of the edge walls, there is clearance between the two folded male walls. However, for containers with a smaller short side or taller side walls, this clearance will cease to exist and the two walls will overlap. Referring to FIG. 9, to accommodate this the upper surface of the base may be formed of two downwards sloping surfaces 52. If the surfaces slope downwards sufficiently, the lower of the two male side walls will be angled downwards so that the second side wall lies horizontally, so allowing the second set of female side walls to fold down to a true horizontal position. Alternatively, if the female pair of walls have recessed inner surfaces, the surface may only need to slope downwards a small amount, resulting in the upper one of the male walls still extending upward a small amount but still allowing the second pair of walls to lie horizontally.

The bulk containers of the invention are intended to be manipulated by fork lifts and accordingly are provided with two outer structures 53 and one central support 54. These structures 53, 54 extend parallel to the long side of the base 12 and are spaced along the short side The lower surface 52 of each of the structures is provided with two recesses 55, which thus define fork receiving slots and two outer feet 56 and one central foot 58. The central support 54 is about twice the width of the outer supports 53 and the central foot 58 is about twice the width of the outer feet 56.

The supports 53, 54 are manufactured separately from the base 12 and are friction welded to the base. The base 12 is formed with a series of downward extending ribs 60 which correspond to ribs 62 on the supports. The ribs 60, 62 are welded together so providing a large welded surface. In normal use the feet are subject to many inadvertent impacts. For instance, the containers may not be raised sufficiently and the feet of the lowest container may hit the edge of a loading dock or truck. Similarly, the forks of the fork lift may not align with the fork receiving slots and hit the feet. This places great stresses on the welds. To improve the durability of the structure the supports are provided with a series of pegs or bosses 64 and the lower surface of the base is provided with corresponding holes 66. The pegs are preferably circular in cross-section but this is not essential. The use of pegs and holes would normally prevent the use of vibration welding, since such welding requires relative movement of the two parts being welded. To overcome this each hole is not circular in cross-section but is oval, so allowing relative motion in one direction but not in the other—the width of the oval corresponding to the diameter of the peg. The oval is arranged with its lengthwise direction perpendicular to the fork slots, in this case parallel to the length of each support. Thus any impacts, which are normally parallel to the fork slots, will be partially transferred between the feet and the base via the hole/peg arrangement.

Whilst the supports extend transversely to the fork slots, it will be appreciated that the fork slots may be defined by parallel extending feet, in which case the oval spigots would extend transversely relative to the feet but still transversely to the fork slots.

It will be noted that each support has three feet, two outer feet and one central foot. The central foot is approximately twice the width of the outer feet, which increases the strength of the unit when it is only supported by its outer feet.

As mentioned earlier, the male walls 14 engage the female walls 16 with triangular tabs which are received in triangular shaped recesses in the inner surface of the female walls. The male walls each rotate about their hinge axis and so the lowermost tab/recess combination will commence engagement before the uppermost and (inherently) when the angle of the male wall to the female wall is greater. Typically the lower combination may commence engagement at 45° rotation whilst the upper combination commences engagement at almost 90° rotation. The use of different angled triangular tabs successfully deals with the problems of different angles of engagement. By using different angles, the tabs in fact engage (overlap) the walls at about the same angle of rotation and provide a roughly similar amount of overlap from the bottom latch to the top latch, so improving the rigidity of the engagement. In the preferred embodiment there are provided six tabs, with the lowest tab, 40*a* having an included angle of about 80° and the upper tab 40*f* having an included angle of about 20°. The included angles and tabs 40*b* to 40*e* lie between these two extremes. The two lower tabs 40*a* and 40*b* have horizontal lead-ins 43 to enable the tabs to be placed closer to each other than otherwise.

A final aspect of the invention relates to the stacking capability of the bulk container. The top of the side walls 14, 16 are provided with a step 70 which has an outer side surface 72 and a base surface 74. The outer surface is inclined outwardly in the upwards direction and the base surface is inclined upwardly at about 12° inwardly. The perimeter edge of the supports 53 are provided with a recess or groove 76 which is complementary to the base surface 74 and about 14 mm wide.

This ensures that the supports of containers in a stack mate securely with the side walls of the container below. Further, the slope of the lower surface 74 causes the side walls to lock against the supports. The downward weight of the upper container will tend to cause the lower surface to move inwards, but such movement is prevented by the outer surface 72 bearing on the support whilst outward movement of the side wall is resisted by the need to raise the container (s) for this to happen. The outwardly extending outer surface 72 aids in placing the pallets in a stack.

The recess 76 on the lower surface of the feet has the same effect with cardboard walls as with moulded side walls, even when the top surfaces of the cardboard walls are horizontal. The recess 76 will tend to force the cardboard walls inwards, so improving the stability of the stack and preventing the side walls bowing outwards.

It will be appreciated by those skilled in the art that many modifications and variations may be made to the embodiments described herein without departing from the spirit or scope of the invention.

What is claimed is:

1. A folding bulk container comprising:

a base unit including a base and peripheral edge wall extending upwardly from the base, which edge wall has an outer surface, an inner surface and an upper surface, and at least one side wall pivotably mounted on the base unit for rotation about a fixed axis and for movement between an erect position and a folded position, wherein the upper edge wall surface is a substantially planar inclined surface which extends upwardly from the outer edge wall surface to the inner edge wall surface and the side wall includes a complementary surface corresponding to the upper edge wall surface.

2. A bulk container according to claim 1, wherein the base unit includes a floor and the pivotal mounting of the side wall includes a binge pin positioned relative to the bottom of the side wall whereby, when the side wall is moved through an arc from a substantially horizontal to a substantially vertical position, the bottom of the side wall locks against the floor of the base unit thereby retarding the side wall from pivoting substantially beyond 90 degrees.

3. A bulk container according to claim 2, wherein the edge wall retards the side wall from pivoting substantially beyond the vertical.

4. A bulk container according to claim 3, wherein the upper surface of the edge wall is inclined approximately 12 degrees to the horizontal.

5. A bulk container according to claim 1, wherein the side wall is pivotably mounted on the base unit about an axis located outside of a space defined by a first plane in which the outer edge wall surface substantially lies and a second plane in which the inner edge wall surface substantially lies.

6. A bulk container according to claim 3, wherein the bottom of the side wall is recessed and the hinge pin is not located in the edge wall but is sufficiently spaced from the outer surface of the edge wall inside the base unit to define the centre of an arc through which the complementary surface of the side wall travels, whereby the complementary surface of the side wall is located on top of the upper surface of the edge wall when the side wall is pivoted into the vertical position.

7. A bulk container according to claim 1, wherein:

the container includes an opposed pair of side walls pivotably mounted on the base unit for movement between upright erect positions and horizontal folded positions, each of said side walls having an inner side wall surface, an outer side wall surface and an upper side wall surface extending from the outer side wall surface to said inner side wall surface, in said erect position said upper side wall surface has a first side wall portion which extends downwardly and inwardly from the outer side wall surface and a second side wall portion which extends inwardly and upwardly to said inner side wall surface, and the base unit includes longitudinally extending supports depending downwardly along or adjacent two spaced apart side edges, each of said supports has a lower support surface including a complementary support portion which extends upwardly and inwardly complementary to said second side wall portion, whereby a plurality of erect containers may be stacked one on top of another such that the complementary support portion of a first container rests on the upper side wall surface of an adjacent lower container.

8. A bulk container according to claim 7, wherein the second side wall portion extends upwardly at approximately 12 degrees to the horizontal when the side wall is in the erect position.

9. A bulk container according to claim 1, wherein the base includes an underside base surface and at least one support mounted to the underside base surface, the support and the base have complementary engagement means including at least one male extension adapted to cooperate with one female receptacle, said male extension having a cross-sectional width in a transverse direction and a cross-sectional length in a longitudinal direction, said female receptacle having a cross-sectional width in the transverse direction and a cross-sectional length in the longitudinal direction, and the cross-sectional width of the male extension and the female receptacle are substantially the same and the cross-sectional length of the female receptacle is greater than the cross-sectional length of the male extension.

10. A bulk container according to claim 9, wherein the support is friction-welded or press-fitted to the base.

11. A bulk container according to claim 9, wherein the male extension is circular in cross-section and the female receptacle is slot-shaped in cross-section with straight elongated sides and rounded ends, the rounded ends having a radius adapted to conform substantially and fit within the radius of the female receptacle.

12. A bulk container according to claim 11, wherein the length of the elongated sides is sufficient to enable free movement of the male extension in the longitudinal direction during friction welding and to assist the support in withstanding lateral is and longitudinal impacts.

13. A bulk container according to claim 9, wherein the base includes a middle support and two corner supports and wherein the middle support is substantially wider than the corner supports.

14. A bulk container according to claim 1, wherein the container includes an opposed pair of side walls pivotably mounted on the base unit which are adapted to travel between erect and folded positions;

the base includes an upper base surface against which all or part of the inner surface of at least one of the side walls rests when in the folded position, said upper base surface and the inner side wall surface being configured to allow the first folded side wall to pivot more than 90 degrees between the vertical position and the folded position, whereby the free end of the first folded side wall is lower than if the upper base surface were not so configured.

15. A bulk container according to claim 14, wherein the upper base surface is V-shaped.

16. A bulk container according to claim 15, wherein the upper base surface is bilaterally symmetrical.

17. A bulk container according to claim 14, wherein the first folded side wall pivots sufficiently to allow the other side wall to lie substantially horizontal, when the pair of side walls are in the folded position.

18. A bulk container according to claim 1, wherein the side wall is pivotably mounted on the base unit inwardly of the inner edge wall surface about a revolving axis substantially parallel to the edge wall;

said side wall is movable between the erect position in which it is substantial vertical and the folded position in which it is substantially horizontal;

said side wall has a first lower portion having a lower portion outer surface which, when the side wall is in the erect position, extends generally vertically adjacent to the inner edge wall surface to at least the highest point of the edge wall and, when the side wall is in the folded position, extends generally horizontally below a horizontal plane passing through said highest point of the edge wall.

19. A bulk container according to claim 18, wherein the side wall in the erect position has a higher portion with a higher outer portion surface substantially coplanar with the outer edge wall surface.

20. A bulk container according to claim 19, wherein the side wall has an intermediate side wall surface extending between the lower portion outer surface and the higher portion outer surface, which intermediate side wall surface is complementary to the upper surface of the edge wall.

21. A bulk container according to claim 1, wherein the upper edge wall surface is flat or radiused and extends generally downwardly from the inner edge wall surface to the outer edge wall surface.

22. A bulk container according to claim 1, wherein the container includes two adjacent pairs of opposed side walls, each side wall terminating at its sides in end walls, the adjacent pairs of opposed side walls adapted to engage each other in the erect position by a series of engaging male tabs and corresponding female receptacles, and said male tabs extend from each of the end walls of a first opposed pair of side walls and engage corresponding said female receptacles in the end walls of the other opposed pair of said tabs and receptacles extending away from the axes of rotation of each of the side walls.

23. A bulk container according to claim 22, wherein the tabs and receptacles have a generally triangular shape, the included angle of the apex of each tab being less than the included angle of the apex of the adjacent tab nearer the axis about which each side wall pivots.

24. A bulk container according to claim 23, wherein the included angle of the apex of each tab ranges from about 80° adjacent the axis to about 20° furthest from the axis.

25. A bulk container according to claim 1, wherein the base unit includes an injection moulded plastics base having an upper base surface and said edge wall is blown to form an enclosed void which extends substantially along the length of the edge wall between the inner and outer edge wall surfaces.

26. A bulk container according to claim 25, wherein each of the walls of which the inner and outer edge wall surfaces form a part are approximately one third the thickness of the edge wall in total.

27. A bulk container according to claim 1, wherein the outer edge wall surface is substantially planar.

* * * * *